United States Patent [19]

Kojola

[11] Patent Number: 4,687,921

[45] Date of Patent: Aug. 18, 1987

[54] PHOTOMULTIPLIER USED IN LIQUID SCINTILLATION COUNTING WITH SPECIMEN-ENCIRCLING CURVED PHOTOCATHODE

[75] Inventor: Hannu Kojola, Riihikoski, Finland

[73] Assignee: Wallac Oy, Finland

[21] Appl. No.: 661,219

[22] Filed: Oct. 15, 1984

[30] Foreign Application Priority Data

Oct. 28, 1983 [FI] Finland ..... 83 3966

[51] Int. Cl.[4] ..... H01J 40/14

[52] U.S. Cl. ..... 250/207; 313/532

[58] Field of Search ..... 250/213 VT, 361 R, 361 C, 250/364, 366, 207; 313/542, 543, 532-536; 356/317, 318

[56] References Cited

U.S. PATENT DOCUMENTS

| | | | |
|---|---|---|---|
| 3,515,872 | 6/1970 | Patzelt et al. | 250/361 R |
| 3,924,132 | 12/1975 | Koslow | 250/361 R |
| 3,944,832 | 3/1976 | Kalish | 250/361 R |
| 4,341,955 | 7/1982 | Mulder et al. | 250/213 VT |

*Primary Examiner*—David C. Nelms

*Attorney, Agent, or Firm*—Steinberg & Raskin

[57] ABSTRACT

A photomultiplier used in liquid scintillation counting has an envelope, a base, an anode, a curved dynode structure and a photocathode. A specimen is inserted in a measuring area of the envelope for liquid scintillation counting. The photocathode has a concave surface, so that the specimen is encircled by the photocathode as completely as possible. The photocathode is positioned at a concave window of the envelope, so that a maximum number of photons directly impinge on the photocathode.

4 Claims, 2 Drawing Figures

PHOTOMULTIPLIER USED IN LIQUID SCINTILLATION COUNTING WITH SPECIMEN-ENCIRCLING CURVED PHOTOCATHODE

BACKGROUND OF THE INVENTION

The present invention relates to a photomultiplier. More particularly, the invention relates to a photomultiplier used in liquid scintillation counting. The photomultiplier has an envelope, a base, an anode, a dynode structure and a photocathode and the specimen is placed in a measuring area of the envelope for scintillation counting.

Two different designs are in principle currently used for the shape of the photocathode of a photomultiplier. The first design utilizes a thin, convex window. The convexity of the cathode surface is a disadvantage of this design.

The second design known in the art utilizes a thick, straight photowindow; that is, the surface of the photocathode is planar. The disadvantage of this design is that comparatively thick glass must be used therein.

SUMMARY OF THE INVENTION

The principal object of the invention is to provide a photomultiplier which is an improvement over photomultiplier designs currently known in the art.

An object of the invention is to provide a photomultiplier in which a maximum proportion of photons are impinged directly onto the photocathode and the remaining photons may be impinged onto the photocathode by a reflector, for example.

The objects of the invention are achieved by a photomultiplier having a photocathode with a concave surface, whereby the specimen is encircled by the photocathode as completely as possible, whereby a maximum of photons are impinged directly onto the photocathode.

The design of the photomultiplier of the invention has the advantage that a considerably greater proportion of photons are impinged directly onto the photocathode and the remaining photons may be impinged onto the photocathode by an appropriate reflector.

BRIEF DESCRIPTION OF THE DRAWINGS

For a fuller understanding of the invention, reference is had to the following description, taken in connection with the accompanying drawings, in which.

DESCRIPTION OF PREFERRED EMBODIMENTS

Figure 1:
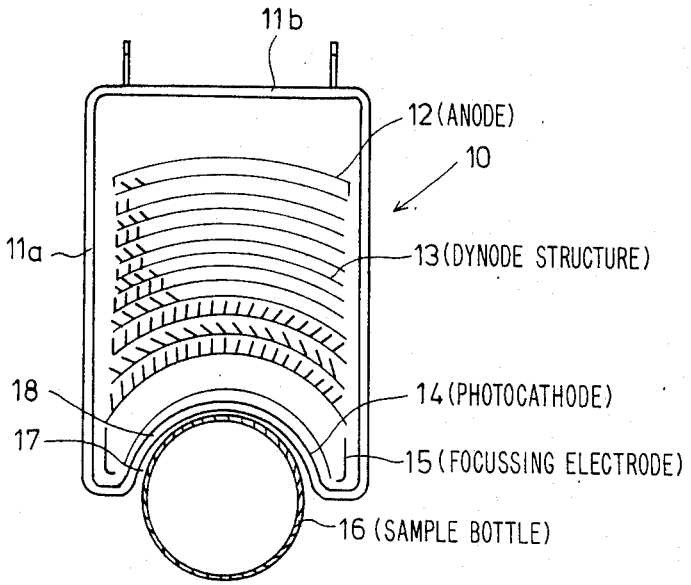
FIG. 1 is a schematic diagram of an embodiment of the photomultiplier viewed from the top and partly in section.
Figure 2:
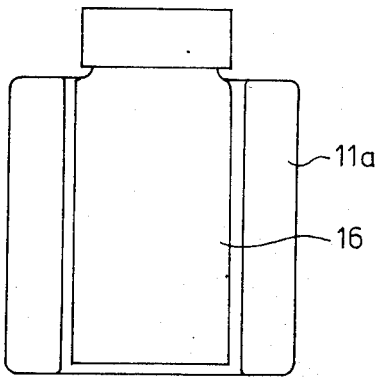
FIG. 2 is an elevational view of the embodiment of FIG. 1.

In the embodiment shown in FIGS. 1 and 2, the photomultiplier 10 has an envelope 11*a*, a base 11*b*, an anode 12, a curved dynode structure 13, a photocathode 14 and a focussing electrode 15. A sample bottle 16 is placed in the measuring area 17 of the envelope 11*a*.

In accordance with the fundamental principle of the invention, the surface of the photocathode 14 is concave, so that the sample bottle 16 is encircled by the surface of the photocathode 14 as completely as possible. When a photomultiplier having the photocathode 14 of the invention is used for liquid scintillation counting, the maximum number of photons are impinged directly onto said photocathode, and the remaining photons are impinged onto said photocathode by appropriate reflectors. The concave photocathode 14 is positioned at a concave or curved window 18 of the envelope 11*a*.

The photocathode 14 is shown in the Figs. of the drawing as a semicylinder. The Figs. show one photomultiplier 10 of a system of two photomultipliers. It is obvious to a person skilled in the art that there may be systems of three or four photomultipliers, also. In such cases, the semicylindrical area of each photomultiplier will be less.

The invention is by no means restricted to the aforementioned details which are described only as examples; they may vary within the framework of the invention, as defined in the following claims.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A photomultiplier for use in liquid scintillation counting, said photomultiplier having an envelope, a base, an anode, a dynode structure, and a measuring area formed by said envelope for accommodating a specimen in liquid scintillation counting, said photomultiplier comprising a photocathode having a concave surface, whereby the specimen is substantially encircled by said photocathode, so that photons are impinged directly onto said photocathode.

2. A photomultiplier as claimed in claim 1, wherein said envelope has a concave window formed therein and said photocathode is positioned at said window.

3. A photomultiplier as claimed in claim 1, wherein said dynode structure is curved substantially concentrically with the concave surface of said photocathode.

4. A photomultiplier as claimed in claim 1, wherein said photomultiplier further has a focussing electrode between said photocathode and said dynode structure.

* * * * *